US007334985B2

(12) United States Patent
Lutjen et al.

(10) Patent No.: US 7,334,985 B2
(45) Date of Patent: Feb. 26, 2008

(54) SHROUD WITH AERO-EFFECTIVE COOLING

(75) Inventors: Paul M. Lutjen, Kennebunkport, ME (US); Dmitriy Romanov, Wells, ME (US); Jeremy Drake, South Berwick, ME (US); Gary Grogg, South Berwick, ME (US); Gregory E. Reinhardt, South Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 121 days.

(21) Appl. No.: 11/247,812

(22) Filed: Oct. 11, 2005

(65) Prior Publication Data

US 2007/0081890 A1 Apr. 12, 2007

(51) Int. Cl.
*F03B 11/00* (2006.01)

(52) U.S. Cl. ..... 415/173.1; 415/173.3; 415/174.2

(58) Field of Classification Search ..... 415/115, 415/116, 173.1, 173.3, 174.2; 416/95, 96 R, 416/96 A, 97 R See application file for complete search history.

(56) References Cited

U.S. PATENT DOCUMENTS

| | | | | |
|---|---|---|---|---|
| 5,169,287 | A * | 12/1992 | Proctor et al. | 415/115 |
| 5,403,159 | A * | 4/1995 | Green et al. | 416/97 R |
| 5,584,651 | A * | 12/1996 | Pietraszkiewicz et al. | 415/115 |
| 6,126,389 | A | 10/2000 | Burdgick | |
| 6,155,778 | A * | 12/2000 | Lee et al. | 415/116 |
| 6,196,792 | B1 * | 3/2001 | Lee et al. | 415/116 |
| 6,302,642 | B1 * | 10/2001 | Nagler et al. | 415/116 |
| 2004/0146399 | A1 | 7/2004 | Bolms | |
| 2005/0123389 | A1 | 6/2005 | Morris | |

* cited by examiner

*Primary Examiner*—Igor Kershteyn

(74) *Attorney, Agent, or Firm*—Carlson, Gaskey & Olds

(57) ABSTRACT

A turbine shroud section includes a cooling passage that bleeds cooling air through an opening in a surface. The cooling passage forms an angle relative to an expected fluid flow direction. The angle defines an angular component in a circumferential direction, which is aligned with the expected fluid flow direction to reduce momentum energy loss of fluid flow through the engine.

21 Claims, 4 Drawing Sheets

SHROUD WITH AERO-EFFECTIVE COOLING

This invention was made with government support under Contract No. F33615-03-D-2354-0001 awarded by the United States Air Force. The government therefore has certain rights in this invention.

BACKGROUND OF THE INVENTION

This invention relates to gas turbine engine shrouds and, more particularly, to a shroud having cooling passages that increase efficiency of the gas turbine engine.

Conventional gas turbine engines are widely known and used to propel aircraft and other vehicles. Typically, gas turbine engines include a compressor section, a combustor section, and a turbine section. Compressed air from the compressor section is fed to the combustor section and mixed with fuel. The combustor ignites the fuel and air mixture to produce a flow of hot gases. The turbine section transforms the flow of hot gases into mechanical energy to drive the compressor. An exhaust nozzle directs the hot gases out of the gas turbine engine to provide thrust to the aircraft or other vehicle.

Typically, shroud sections, also known as blade outer air seals, are located radially outward from the turbine section and function as an outer wall for the hot gas flow through the gas turbine engine. The shroud sections typically include a cooling system, such as a cast, cored, internal cooling passage, to maintain the shroud sections at a desirable temperature. Cooling air is forced through the cooling passages and bleeds into the hot gas flow.

Rotation of turbine blades relative to turbine vanes in the turbine section causes a circumferential component of hot gas flow relative to the engine axis. In conventional shroud sections, the cooling air bleeds into the hot gas flow along an axial direction. Disadvantageously, axial momentum of the discharged cooling air acts against circumferential momentum of the hot gas flow to undesirably reduce the overall momentum of the hot gas flow. This results in an aerodynamic disadvantage that reduces efficiency of turbine blade rotation.

Accordingly, there is a need for shroud sections having cooling passages that minimize momentum loss of the hot gas flow. This invention addresses these needs and provides enhanced capabilities while avoiding the shortcomings and drawbacks of the prior art.

SUMMARY OF THE INVENTION

A turbine shroud section according to the present invention includes a cooling passage that bleeds cooling air into a hot gas flow through an engine. The cooling passage is angled circumferentially to align with a circumferential component of the hot gas flow to reduce momentum energy loss of the hot gas flow and improve the efficiency of the engine.

In one example, the turbine shroud section includes an airfoil-shaped opening to reduce drag on cooling air bled through the cooling passages.

A method of cooling a turbine shroud section according to the present invention includes the steps of defining an expected circumferential fluid flow direction adjacent to a turbine shroud. Coolant discharges from a cooling passage in a direction that is substantially aligned with the expected circumferential fluid flow direction. This provides cooling to the shroud section and reduces momentum loss of the fluid flow.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
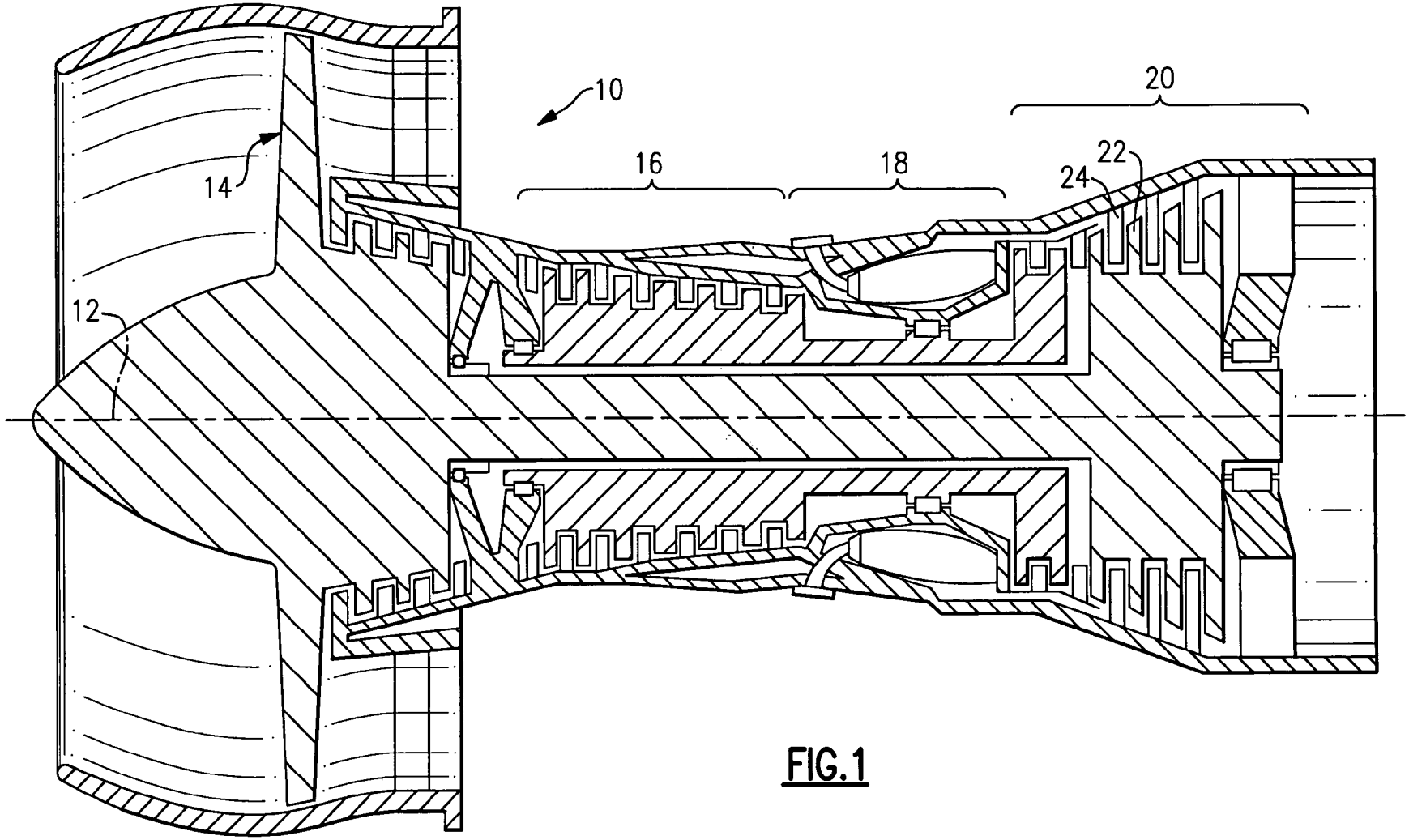
FIG. 1 shows a schematic view of an example gas turbine engine.

FIG. 1 shows a gas turbine engine 10, such as a gas turbine used for power generation or propulsion, circumferentially disposed about an engine centerline 12. The engine 10 includes a fan 14, a compressor section 16, a combustion section 18 and a turbine section 20 that includes a turbine blades 22 and turbine vanes 24. As is known, air compressed in the compressor section 16 is mixed with fuel that is burned in the combustion section 18 to produce hot gases that are expanded in the turbine section 20. FIG. 1 is a somewhat schematic presentation for illustrative purposes only and is not a limitation on the instant invention, which may be employed on gas turbines for electrical power generation, aircraft, etc. Additionally, there are various types of gas turbine engines, many of which could benefit from the present invention, which is not limited to the design shown.

Figure 2:
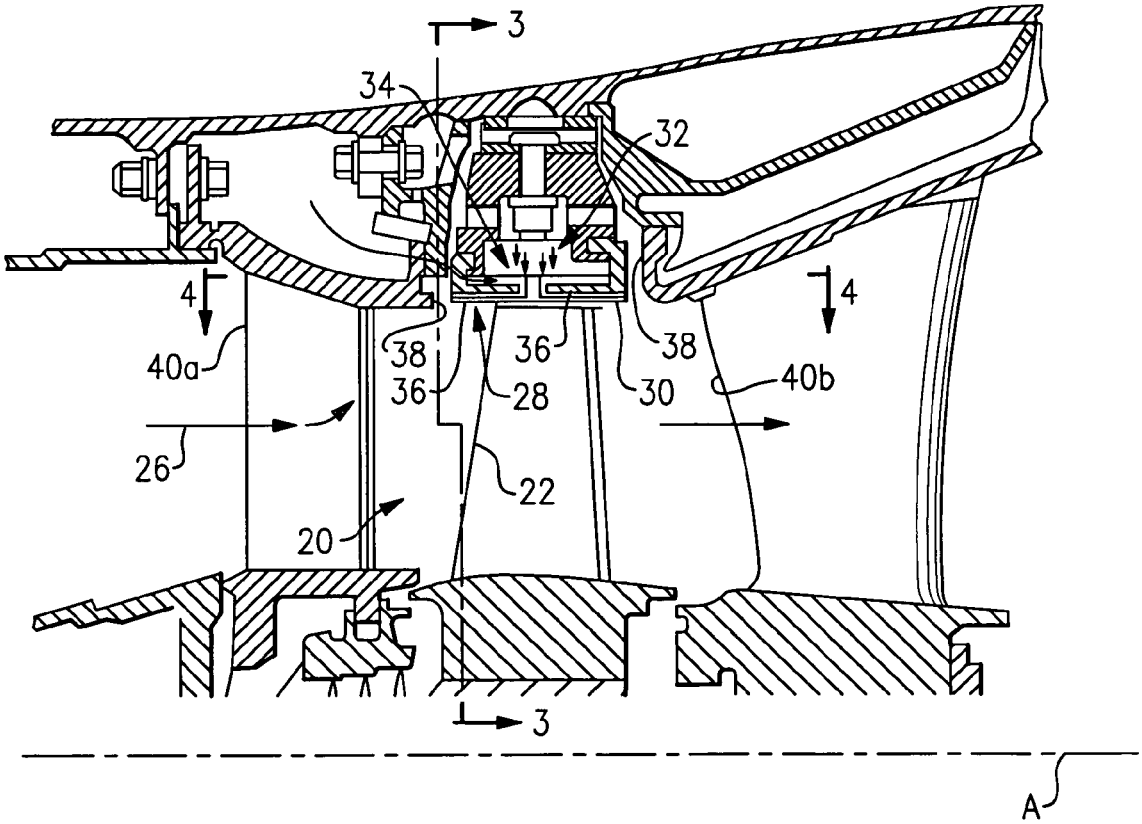
FIG. 2 is a selected portion of a turbine section of the gas turbine engine of FIG. 1.

FIG. 2 illustrates a selected portion of the turbine section 20. The turbine blade 22 receives a hot gas flow 26 from the combustion section 18 (FIG. 1). The turbine section 20 includes a shroud 28 that functions as an outer wall for the hot gas flow 26 through the gas turbine engine 10. The shroud 28 includes shroud sections 30 circumferentially located about the turbine section 20. Each of the shroud section 30 includes a cooling system 32 to maintain the shroud section 30 at a desirable temperature. A compact heat exchanger type of cooling system is shown, however, it is to be recognized that other systems such as impingement, film, or super conductive may also benefit from the invention.

Cooling air 34, such as bleed air from the compressor section 16, is forced through cooling passages 36 in each of the shroud sections 30. In this example, the cooling air 34 bleeds out of the shroud sections 30 into purge gaps 38. One purge gap 38 is adjacent to a forward vane 40*a* and another purge gap 38 is adjacent to a rear vane 40*b*.

Figure 3:
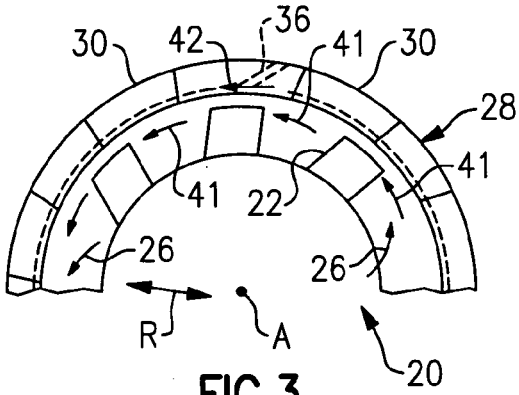
FIG. 3 is an axial view of shroud sections shown in FIG. 2.

Referring to FIG. 3, at least a portion of the hot gas flow 26 moves circumferentially in the turbine section 20. An expected circumferential flow direction 41 of the hot gas flow 26 can be determined using known aerodynamic analysis methods. The cooling passages 36 of the shroud sections 30 are aligned with the expected circumferential flow direction 41 to minimize momentum loss of the hot gas flow 26. In the illustrated example, the cooling passages 36 are angled circumferentially to discharge cooling air in a discharge direction 42, which has a circumferential component that is aligned with the expected circumferential flow direction 41.

Figure 4:
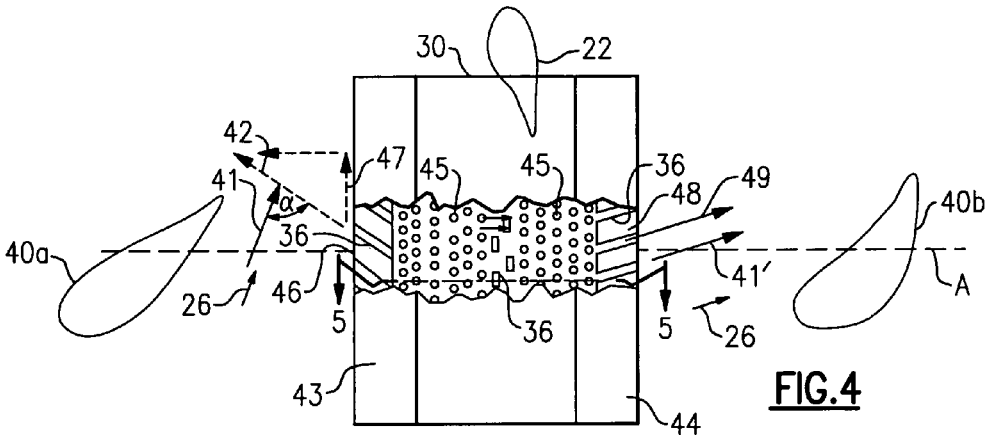
FIG. 4 is a radial view of the shroud section shown in FIG. 2.
Figure 5:
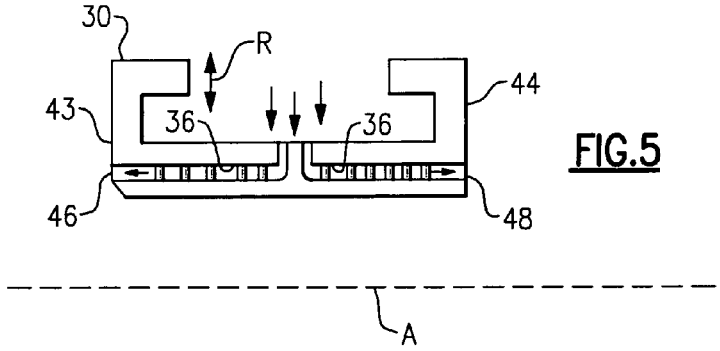
FIG. 5 is a cross-sectional view of the shroud section shown in FIG. 4.

FIG. 4 (radially inward view) and FIG. 5 (axial cross-sectional view) show a leading edge 43 and a trailing edge 44 of the shroud section 30. Cooling air is received from a generally radial direction R into the cooling passages 36 (such as bleed air from the compressor section 16 (FIG. 1) and is discharged through leading edge openings 46 and trailing edge openings 48 into the hot gas flow 26 along the discharge directions 42, 49 respectively. The discharge direction 42 includes a circumferential component 47 that is aligned within approximately a few degrees, for example, with the circumferential expected circumferential flow direction 41. In this example, the circumferential component 47 is perpendicular to the engine central axis A and to the radial direction R.

The expected circumferential flow direction 41 forms an angle $\alpha$ with the discharge direction 42. The angle $\alpha$ corresponds to a momentum loss of the hot gas flow 26 from the discharge of the cooling air into the hot gas flow 26. That is, if the angle $\alpha$ is close to 0°, there is relatively small momentum loss, whereas if the angle $\alpha$ is relatively close to 90° or above 90°, there is a relatively large momentum loss as the discharged cooling air acts against the hot gas flow 26 flowing in the expected circumferential flow direction 41. Preferably, the angle $\alpha$ is close to 0° to minimize momentum loss. This also may minimize a stagnation pressure effect from the hot gas flow 26 opposing the discharge of the cooling air.

At the trailing edge 44, the cooling air is discharged at a second discharge direction 49 that is substantially aligned with an expected hot gas circumferential flow direction 41' at the trailing edge 44. In one example, the second discharge direction 49 is within a few degrees of the expected hot gas flow direction 41'. This provides a benefit of increasing the momentum of the hot gas flow 26 near the trailing edge 44 and provides an efficiency improvement of the turbine section 20.

Figure 6:
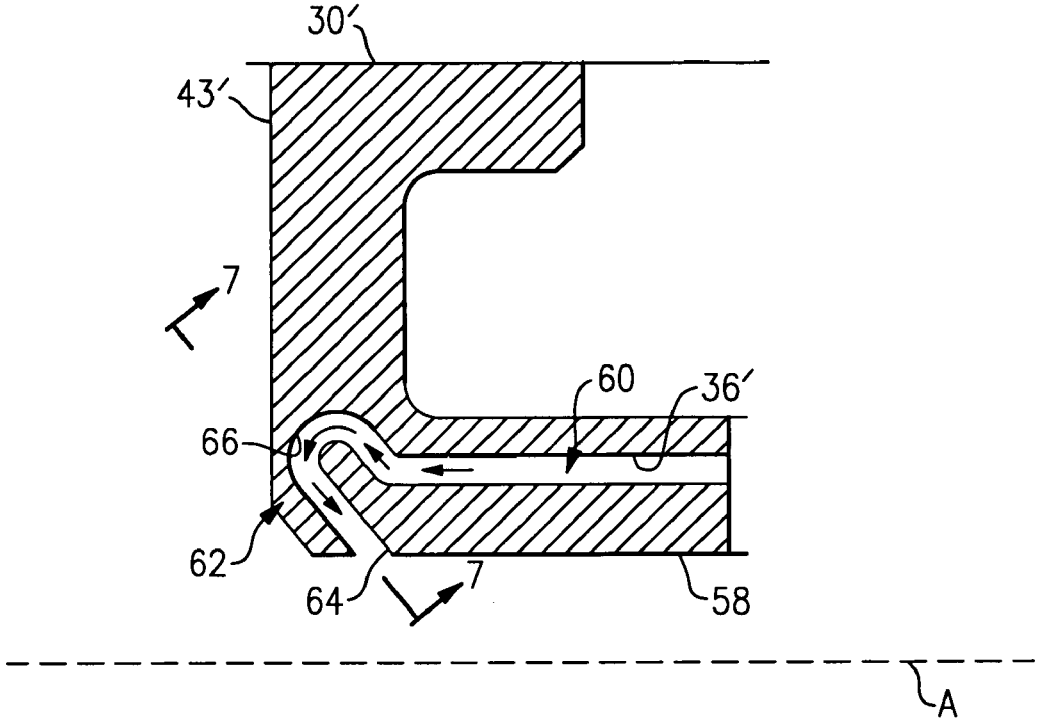
FIG. 6 is a cross-sectional view of a shroud section of a second embodiment for use in the turbine section shown in FIG. 2.

FIG. 6 illustrates selected portions of a second example embodiment 30' that can be used in the turbine section 20 instead of the leading edge of the shroud sections 30 as shown in the examples of FIGS. 5 and 6. The shroud section 30' includes a cooling passage 36' that discharges cooling air through a surface 58 that faces toward the engine central axis A. In this example, the cooling passage 36' includes a first portion 60 and a retrograde portion 62 that angles back toward the first portion 60. The retrograde portion 62 loops radially outward of the first portion 60 and back around toward the surface 58, discharging cooling air through an opening 64 in the surface 58. In this example, the opening 64 is near a leading edge 43' of the shroud section 30', however, other configurations may benefit from a loop near a trailing edge. Looping radially outward allows the shroud section 30' to be more axially compact.

Figure 7:
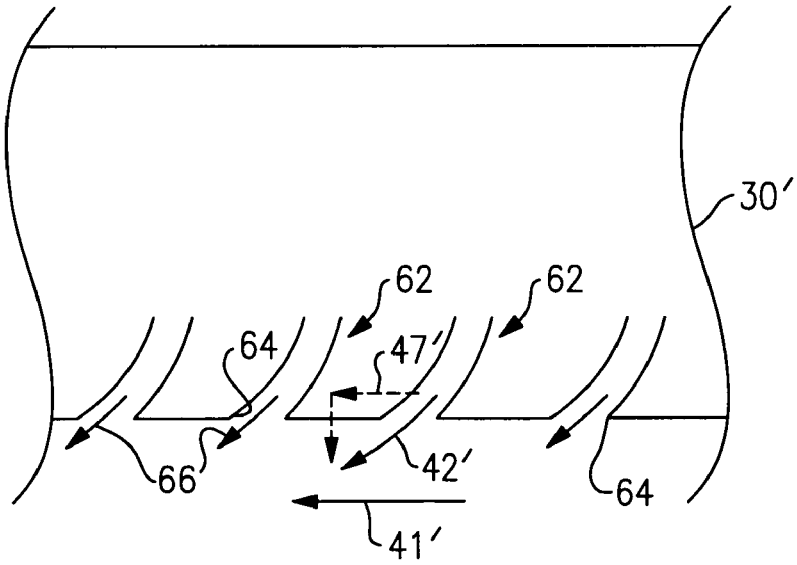
FIG. 7 is a cross-section of the shroud section of FIG. 6.

Referring to FIG. 7, the retrograde portion 62 also angles circumferentially and discharges cooling air in a circumferential discharge direction 42' having a corresponding circumferential component 47' aligned with an expected circumferential flow direction 41' to reduce momentum loss of the hot gas flow 26 similar to as described above.

Figure 8:
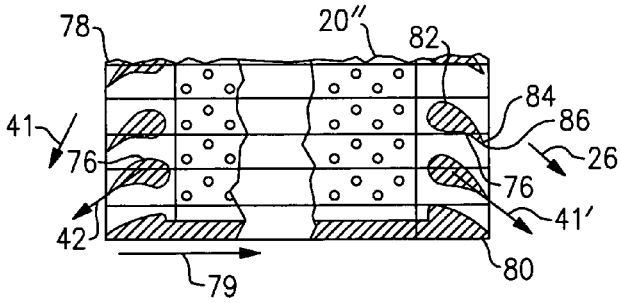
FIG. 8 is a schematic view of a shroud section of a third embodiment having airfoil-shaped openings for use in the turbine section shown in FIG. 2.

FIG. 8 shows a radially outward view of an example third embodiment of a turbine shroud section 30" having openings 76 in a leading edge 78 and a trailing edge 80. In this example, the openings 76 have an airfoil-shape. The airfoil-shape has a nominally wide end 82 that is generally opposite from a nominally narrow end 84 that includes a corner 86. The airfoil-shape reduces drag on cooling air that flows in through the openings 76 into the hot gas flow 26. Previously known openings having multiple corners that produce pressure drops that increase drag. The airfoil-shape, having only one corner, reduces the amount of drag (e.g., from friction loss as indicated by a discharge coefficient) on the discharged cooling air and thereby provides an aerodynamic advantage. It is to be recognized that the airfoil-shape described in this example can also be used for the openings 46, 48, 64 of the previously described examples.

In one example, the airfoil-shape of the openings 76 at the leading edge 78 provides the benefit of consistent cooling air bleed velocity. Turbulence and pressure drops caused by corners of previously known openings are minimized, which results in more consistent and uniform cooling air bleed velocity. This may increase effectiveness of a film 79 of cooling air adjacent to the shroud sections 30" after bleeding from the openings 76.

In another example, the cooling air discharged at the trailing edge 80 has a pressure greater than that of the hot gas flow 26. As a result, the cooling air adds momentum energy to the hot gas flow 26. Reducing the frictional losses through the openings 76 at the trailing edge 80 further increases the pressure difference between the discharged cooling air and the hot gas flow 26. This allows the cooling air to add an even greater amount of momentum energy to the hot gas flow 26.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A turbine shroud section comprising:

a surface extending in a circumferential direction about a longitudinal engine axis; and a cooling passage that penetrates the surface and forms an angle relative to an expected fluid flow direction, the angle having an angular component in the circumferential direction, the cooling passage including an aft portion and a retrograde portion that angles aftly.

2. The turbine shroud section as recited in claim 1, wherein the surface is transverse to the longitudinal engine axis.

3. The turbine shroud section as recited in claim 2, wherein the surface is perpendicular to the longitudinal engine axis.

4. The turbine shroud section as recited in claim 1, wherein the cooling passage includes an opening through the surface to the expected fluid flow direction and the surface is forward-facing.

5. The turbine shroud section as recited in claim 4, further comprising a second cooling passage that opens through an aft-facing surface, the second cooling passage forming a second angle with a second expected fluid flow direction, the second angle having a second angular component in the circumferential direction.

6. The turbine shroud section as recited in claim 5, wherein the second cooling passage is substantially aligned with the second expected fluid flow direction.

7. The turbine shroud section as recited in claim 1, wherein the cooling passage includes an opening through the surface and the surface faces radially inward.

8. The turbine shroud section as recited in claim 1, wherein the cooling flow passage includes an airfoil-shaped opening.

9. The turbine shroud section as recited in claim 1, wherein the angular component is perpendicular to the longitudinal engine axis and a radial direction.

10. The turbine shroud section as recited in claim 1, further comprising a single integral cast section tat defines the surface and the cooling passage.

11. The turbine shroud section as recited in claim 1, wherein the cooling passage includes an aft portion and a retrograde portion that angles aftly.

12. The turbine shroud section as recited in claim 11, wherein the retrograde portion is at least partially radially outward from the aft portion.

13. A turbine engine including a plurality of the turbine shroud sections of claim 1 disposed circumferentially about turbine blades that rotate about an engine centerline, further including at least a fan section intaking air, a compressor section compressing said air, and a combustion section receiving said air to combust fuel.

14. A turbine component comprising:

a turbine shroud section having a surface extending in a circumferential direction relative to a longitudinal engine axis, the turbine shroud section having a cooling passage that discharges coolant and an airfoil-shaped opening in fluid communication with the cooling passage.

15. The turbine shroud section as recited in claim 14, wherein the airfoil-shaped opening includes a nominally wide end that is curved and a nominally narrow end having a corner.

16. The turbine shroud section as recited in claim 14, wherein the airfoil-shaped opening is in a forward-facing surface.

17. The turbine shroud section as recited in claim 14, wherein the airfoil-shaped opening is in a surface that faces radially inward relative to an engine central axis.

18. The turbine shroud section as recited in claim 14, wherein the cooling passage includes an aft portion and a retrograde portion that angles aftly.

19. The turbine shroud section as recited in claim 14, wherein the cooling passage forms an angle relative to an expected fluid flow direction, the angle having an angular component in the circumferential direction.

20. A method of cooling a turbine shroud including the steps of:

(a) defining an expected circumferential fluid flow direction adjacent to a turbine shroud;

(b) discharging a coolant from a turbine shroud cooling passage through an airfoil-shaped opening in a direction having a circumferential component substantially aligned with the expected circumferential fluid flow direction.

21. The method as recited in claim 20, including casting the shroud section as a single integral section to form the cooling flow passage.

* * * * *

UNITED STATES PATENT AND TRADEMARK OFFICE

CERTIFICATE OF CORRECTION

PATENT NO. : 7,334,985 B2
APPLICATION NO. : 11/247812
DATED : February 26, 2008
INVENTOR(S) : Lutjen et al.

It is certified that error appears in the above-identified patent and that said Letters Patent is hereby corrected as shown below:

Claim 10, Column 5, line 14: “tat” should read as --that--

Signed and Sealed this

Twenty-fourth Day of June, 2008

JON W. DUDAS
*Director of the United States Patent and Trademark Office*